US009341980B2

(12) United States Patent
Sanada

(10) Patent No.: US 9,341,980 B2
(45) Date of Patent: May 17, 2016

(54) PROCESS UNIT AND IMAGE FORMING APPARATUS

(71) Applicant: Takahiro Sanada, Hyogo (JP)

(72) Inventor: Takahiro Sanada, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/800,618

(22) Filed: Jul. 15, 2015

(65) Prior Publication Data

US 2016/0018756 A1 Jan. 21, 2016

(30) Foreign Application Priority Data

Jul. 16, 2014 (JP) ..... 2014-146094

(51) Int. Cl.
*G03G 15/08* (2006.01)
*G03G 15/06* (2006.01)

(52) U.S. Cl.
CPC ..... *G03G 15/081* (2013.01); *G03G 15/065* (2013.01)

(58) Field of Classification Search
CPC ..... G03G 15/065; G03G 15/081
See application file for complete search history.

(56) References Cited

U.S. PATENT DOCUMENTS 6,855,468 B1 * 2/2005 Yamamoto ..... G03G 15/0126 430/45.5
2006/0029436 A1 * 2/2006 Toyoda ..... G03G 9/0827 399/279
2007/0110482 A1 * 5/2007 Kazaki ..... G03G 15/0812 399/279
2011/0123918 A1 * 5/2011 Udo ..... G03G 9/09 430/108.2
2013/0058670 A1 3/2013 Nakatake et al.
2013/0266332 A1 10/2013 Miyazaki et al.
2014/0161471 A1 6/2014 Matsuno et al.

FOREIGN PATENT DOCUMENTS

JP 2004-054172 2/2004

* cited by examiner

*Primary Examiner* — David Gray
*Assistant Examiner* — Thomas Giampaolo, II
(74) *Attorney, Agent, or Firm* — Duft Bornsen & Fettig LLP

(57) ABSTRACT

A process unit includes a latent image bearer, a developer bearer, a regulator, a supplier, and at least one voltage applicator. The latent image bearer bears a latent image on a surface thereof. The developer bearer supplies a developer onto the latent image bearer to make the latent image a visible image. The regulator regulates a thickness of a layer of the developer on the surface of the developer bearer. The supplier supplies the developer to the developer bearer. At least one voltage applicator applies a voltage to the developer bearer and the latent image bearer. After the developer bearer rotates with no voltage or a same amount of voltage applied to the developer bearer and the regulator in a non-image-formation period, to perform a removal operation to remove a residual developer from the developer bearer, the developer bearer rotates with a voltage applied to the developer bearer and a latent image bearer rotates with the latent image bearer applied with a voltage and exposed with an irradiator, to perform a delivery operation to deliver the residual developer.

19 Claims, 6 Drawing Sheets

FIG. 8

| | OPERATION SETTING VALUE | | | | | TONER | | EVALUATION RESULT | |
|---|---|---|---|---|---|---|---|---|---|
| | t1 | t2 | t3 | N | PER | POWDER DIAMETER | SILICONE OIL CONTAINING SILICA | HALFTONE IMAGE STREAK | PHOTO-CONDUCTOR WEARING AMOUNT AND RESULT |
| EX. 1 | 1.5 SEC. | 0.15 SEC. | 0.3 SEC. | 3 TIMES | 100 SHEETS | 6.5 μm | CONTAINED | GOOD | 2.7 GOOD |
| EX. 2 | 1.5 SEC. | 0.15 SEC. (SUPPLY ROLLER: 0 SEC.) | 0.3 SEC. | 3 TIMES | 100 SHEETS | 6.5 μm | CONTAINED | GOOD | 2.5 GOOD |
| EX. 3 | 1.5 SEC. | 0.15 SEC. | 0.3 SEC. | 3 TIMES | 25 SHEETS | 6.5 μm | CONTAINED | GOOD | 2.0 GOOD |
| EX. 4 | 1.5 SEC. | 0 SEC. | 0.3 SEC. | 3 TIMES | 100 SHEETS | 6.5 μm | CONTAINED | FAIR | 2.5 GOOD |
| COMP. EX. 1 | 1.5 SEC. | 0.15 SEC. | 0.3 SEC. | 3 TIMES | 500 SHEETS | 6.5 μm | CONTAINED | POOR | 3.0 GOOD |
| COMP. EX. 2 | 6.5 SEC. | 5 SEC. | 0.3 SEC. | 3 TIMES | 100 SHEETS | 6.5 μm | CONTAINED | POOR | 3.2 GOOD |
| COMP. EX. 3 | 1.5 SEC. | 0.15 SEC. | 0 SEC. | 3 TIMES | 100 SHEETS | 6.5 μm | CONTAINED | POOR | 3.0 GOOD |
| COMP. EX. 4 | 1.5 SEC. | 0.15 SEC. | 0.3 SEC. | 3 TIMES | 100 SHEETS | 7.5 μm | NOT ADDED | POOR | 11.5 POOR |

PROCESS UNIT AND IMAGE FORMING APPARATUS

CROSS-REFERENCE TO RELATED APPLICATIONS

This patent application is based on and claims priority pursuant to 35 U.S.C. §119(a) to Japanese Patent Application No. 2014-146094, filed on Jul. 16, 2014, in the Japan Patent Office, the entire disclosure of which is incorporated by reference herein.

BACKGROUND

1. Technical Field

Embodiments of this disclosure relate to a process unit and an image forming apparatus such as a copying machine, a printer, a facsimile, or a multifunction peripheral of at least one of the foregoing capabilities, incorporating the process unit.

2. Description of the Related Art

In an image forming apparatus such as a copying machine, a printer, a facsimile, or a multifunction peripheral of at least one of the foregoing capabilities, an electrostatic latent image which is formed on a photoconductor as a latent image bearer becomes a visible image by a developer supplied from a developing device.

In recent years, there has been a demand for saving energy and improving durability from the viewpoint of environmental problems in such an image forming apparatus. Here, a countermeasure has been set up which saves the energy of a developing operation by preparing a toner with a low melting point as a developer used for a developing operation so as to decrease a fixing temperature and which reduces the wear of a surface of a photoconductor caused by the friction of the photoconductor against a toner by adding an external additive to the toner so as to improve the fluidity of the toner.

SUMMARY

In an aspect of the present disclosure, there is provided a process unit including a latent image bearer, a developer bearer, a regulator, a supplier, and at least one voltage applicator. The latent image bearer bears a latent image on a surface thereof. The developer bearer supplies a developer onto the latent image bearer to make the latent image a visible image. The regulator regulates a thickness of a layer of the developer on the surface of the developer bearer. The supplier supplies the developer to the developer bearer. At least one voltage applicator applies a voltage to the developer bearer and the latent image bearer. After the developer bearer rotates with no voltage or a same amount of voltage applied to the developer bearer and the regulator in a non-image-formation period, to perform a removal operation to remove a residual developer from the developer bearer, the developer bearer rotates with a voltage applied to the developer bearer and a latent image bearer rotates with the latent image bearer applied with a voltage and exposed with an irradiator, to perform a delivery operation to deliver the residual developer.

In an aspect of the present disclosure, there is provided an image forming apparatus including a latent image bearer, an irradiator, a developer bearer, a regulator, a supplier, at least one voltage applicator, and a controller. The latent image bearer bears a latent image on a surface thereof. The irradiator exposes the latent image bearer. The developer bearer supplies a developer onto the latent image bearer to make the latent image a visible image. The regulator regulates a thickness of a layer of the developer on the surface of the developer bearer. The supplier supplies the developer to the developer bearer. At least one voltage applicator applies a voltage to the developer bearer and the latent image bearer. The controller controls the developer bearer to rotate with no voltage or a same amount of voltage applied to the developer bearer and the regulator in a non-image-formation period, to perform a removal operation to remove a residual developer from the developer bearer, and then controls the developer bearer to rotate with a voltage applied to the developer bearer and the latent image bearer to rotate with the latent image bearer applied with a voltage and exposed with the irradiator, to perform a delivery operation to deliver the residual developer.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 8 is a table of test results for wear of a photoconductor drum and an image formation state in an image forming apparatus using a method of driving a process unit according to an embodiment of the present disclosure.

Figure 1:
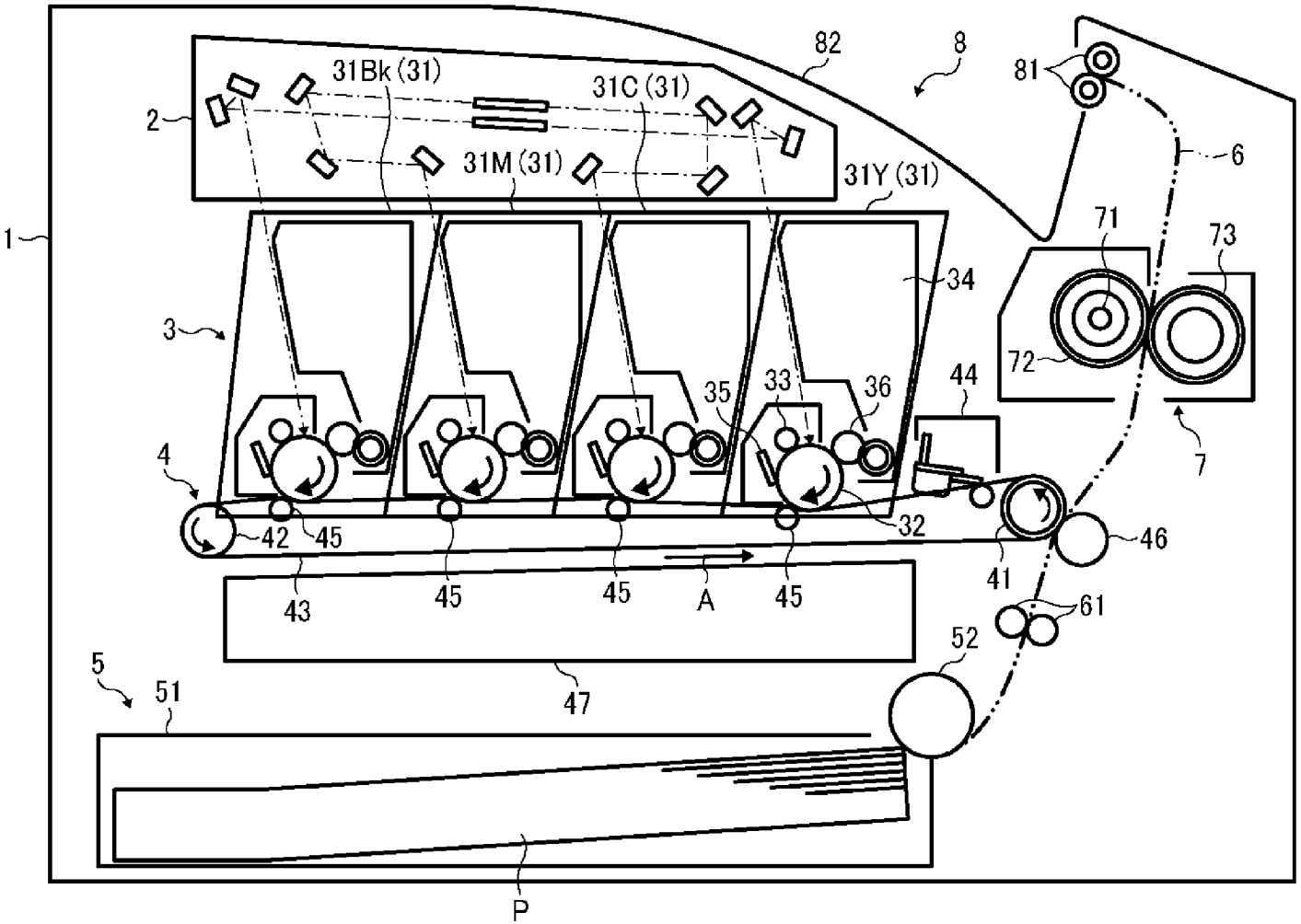
FIG. 1 is a schematic configuration diagram of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

For a toner with a low melting point, a glass transition temperature Tg of adhesive resin of base particles decreases with a decrease in fixing temperature, and hence the toner easily adheres to a component even when the fixing operation is not performed. For this reason, the toner is heated by the friction heat generated between a developing roller and a regulator during a developing operation. As a result, the toner adheres to and resides in the components. Further, even when the added external additive is separated from the toner during the developing operation, these residual materials are generated. Then, since clogging is generated due to the residual materials generated in the regulator, a toner layer of the developing roller becomes non-uniform. As a result, a faulty image formation may occur.

However, as described below, according to at least one embodiments of this disclosure, a developer bearer of a process unit is driven with no voltage or the same amount of voltage applied to the developer bearer and a regulator to remove a residual material, such as developer having opposite charge, residing between the developer bearer and the regulator and deliver onto a surface of the developer bearer. Such a removed residual material is carried on the surface of the developer bearer to a position at which the developer bearer and a latent image bearer oppose each other. In a delivery operation, the developer bearer and the latent image bearer are applied with voltage and exposed, and the removed residual material is delivered from the developer bearer to the latent image bearer by a potential difference between the developer bearer and the latent image bearer. Thus, the residual material residing between the developer bearer and the latent image bearer is removed and delivered onto the latent image carrier disposed on a downstream side.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an embodiment of the present disclosure will be described with reference to the drawings. In addition, the same reference numeral will be given to the same or equivalent component, and the repetitive description thereof will be appropriately simplified or omitted.

(Description of Image Forming Apparatus)

As illustrated in FIG. 1, an image forming apparatus 1 includes an irradiator 2 as an exposure device, an image forming unit 3, a transfer device 4, a sheet feeder 5, a transport passage 6, a fixing device 7, and an ejection unit 8.

The irradiator 2 is located at the upper part of the image forming apparatus 1, and includes various optical systems or a light source emitting a laser beam. Specifically, a surface of a photoconductor is exposed in a manner such that a laser beam for each color separation component of an image created based on image data obtained from an image acquisition unit irradiates toward a photoconductor of the image forming unit 3 to be described later.

The image forming unit 3 is located below the irradiator 2, and includes a plurality of process units 31 removably attached to the image forming apparatus 1. Each process unit 31 includes a photoconductor drum 32 which serves as a latent image bearer capable of bearing a toner as a developer on a surface of the photoconductor drum, a charging roller 33 which serves as an applicator uniformly charging the surface of the photoconductor drum 32, a developing device 34 which supplies a toner to the surface of the photoconductor drum 32, and a photoconductor cleaning blade 35 which serves as a collector cleaning the surface of the photoconductor drum 32. In addition, each process unit 31 includes four process units 31 (31Y, 31C, 31M, and 31Bk) which respectively correspond to different colors of yellow, cyan, magenta, and black as the color separation components of the color image. Since the four process units have the same configuration except that different colors of the toner are contained in the four process units, the reference numerals thereof are omitted.

The transfer device 4 is located directly below the image forming unit 3. The transfer device 4 includes an endless intermediate transfer belt 43 which is stretched around a drive roller 41 and a driven roller 42 so as to travel along a circulation track, a cleaning blade 44 which cleans a surface of the intermediate transfer belt 43, and a primary transfer roller 45 which is arranged at a position facing the photoconductor drum 32 of each process unit 31 with the intermediate transfer belt 43 interposed therebetween. Each primary transfer roller 45 presses an inner circumferential surface of the intermediate transfer belt 43 at each position, and a primary transfer nip is formed at a position where a pressed portion of the intermediate transfer belt 43 contacts each photoconductor drum 32.

Further, a secondary transfer roller 46 is disposed at a position facing the drive roller 41 with the drive roller 41 of the intermediate transfer belt 43 and the intermediate transfer belt 43 interposed therebetween. The secondary transfer roller 46 presses an outer circumferential surface of the intermediate transfer belt 43, and a secondary transfer nip is formed at a position where the secondary transfer roller 46 and the intermediate transfer belt 43 contact each other. Further, a waste toner container 47 which contains a waste toner cleaned by the cleaning blade 44 is disposed below the intermediate transfer belt 43 via a waste toner transport tube.

The sheet feeder 5 is located at the lower part of the image forming apparatus 1, and includes a sheet feed tray 51 which contains a recording sheet P as a recording medium or a sheet feed roller 52 which feeds a recording sheet P from the sheet feed tray 51.

The transport passage 6 is a transport path which transports the recording sheet P fed from the sheet feeder 5, and a pair of transport rollers is appropriately disposed in the course of the transport passage 6 up to the ejection unit 8 to be described later in addition to a pair of registration rollers 61.

The fixing device 7 includes a fixing roller 72 which is heated by a heater 71 and a pressure roller 73 which presses the fixing roller 72.

The ejection unit 8 is provided at the most downstream side of the transport passage 6 of the image forming apparatus 1. The ejection unit 8 is equipped with a pair of sheet ejection rollers 81 which ejects the recording sheet P to the outside and a sheet ejection tray 82 which stocks the ejected recording medium.

Hereinafter, a basic operation of the image forming apparatus 1 will be described with reference to FIG. 1.

When an image forming operation is started in the image forming apparatus 1, an electrostatic latent image is formed on the surface of each photoconductor drum 32 of the process units 31Y, 31C, 31M, and 31Bk. The image information for the exposure of each photoconductor drum 32 is monochrome image information in which a desired full-color image is separated as color information of yellow, cyan, magenta, and black. An electrostatic latent image is formed on each photoconductor drum 32, and a toner contained in each developing device 34 is supplied to the photoconductor drum 32 by a developing roller 36 as a developer bearer, so that the electrostatic latent image is made visible as a toner image (a developer image) by a developing operation.

Next, the drive roller 41 of the transfer device 4 is rotated in the counter-clockwise direction of FIG. 1 so that the intermediate transfer belt 43 is driven so as to travel in a direction indicated by the arrow A of FIG. 1. Further, a constant voltage having a polarity opposite to the charge polarity of the toner or a voltage controlled as a constant current is applied to each primary transfer roller 45. Accordingly, a transfer electric field is formed at a primary transfer nip between each primary transfer roller 45 and each photoconductor drum 32. Then, toner images of different colors respectively formed on the photoconductor drums 32 of the process units 31Y, 31C, 31M, and 31Bk are sequentially transferred onto the intermediate transfer belt 43 by the transfer electric field formed at the primary transfer nip. Thus, a toner image of a full color is formed on the surface of the intermediate transfer belt 43. The toner which remains on the photoconductor drum 32 after the primary transfer is removed by the photoconductor cleaning blade 35, and is contained in the waste toner container 47.

Meanwhile, when an image forming operation is started, the sheet feed roller 52 of the sheet feeder 5 is rotated at the lower portion of the image forming apparatus 1, so that the recording sheet P contained in the sheet feed tray 51 is fed to the transport passage 6. The recording sheet P which is fed to the transport passage 6 is fed to the secondary transfer nip between the secondary transfer roller 46 and the drive roller 41 facing the secondary transfer roller while the timing is set by the registration roller 61. At this time, a transfer voltage having a polarity opposite to the toner charge polarity of the toner image on the intermediate transfer belt 43 is applied to the secondary transfer roller 46, so that a transfer electric field is formed at the secondary transfer nip. Then, the toner images on the intermediate transfer belt 43 are transferred onto the recording sheet P together by the transfer electric field formed at the secondary transfer nip.

The recording sheet P onto which the toner images are transferred is transported to the fixing device 7 and the recording sheet P is heated and pressed by the pressure roller 73 and the fixing roller 72 heated by the heater 71, so that the toner images are fixed onto the recording sheet P. Then, the recording sheet P onto which the toner images are fixed is separated from the fixing roller 72, is transported by a pair of transport rollers, and is ejected to the sheet ejection tray 82 by a sheet ejection roller 81 of the ejection unit 8. Further, a residual toner adhering onto the intermediate transfer belt 43 after the transfer operation is removed by the cleaning blade 44. The removed toner is transported by a screw or a waste toner transport tube so as to be collected in the waste toner container 47.

An image forming operation of forming a full-color image on the recording sheet P has been made so far. However, a monochrome image may be formed by using any one of four process units 31Y, 31C, 31M, and 31Bk or an image may be formed by two or three colors using two or three process units 31.

(Description of Process Unit)

Figure 2:
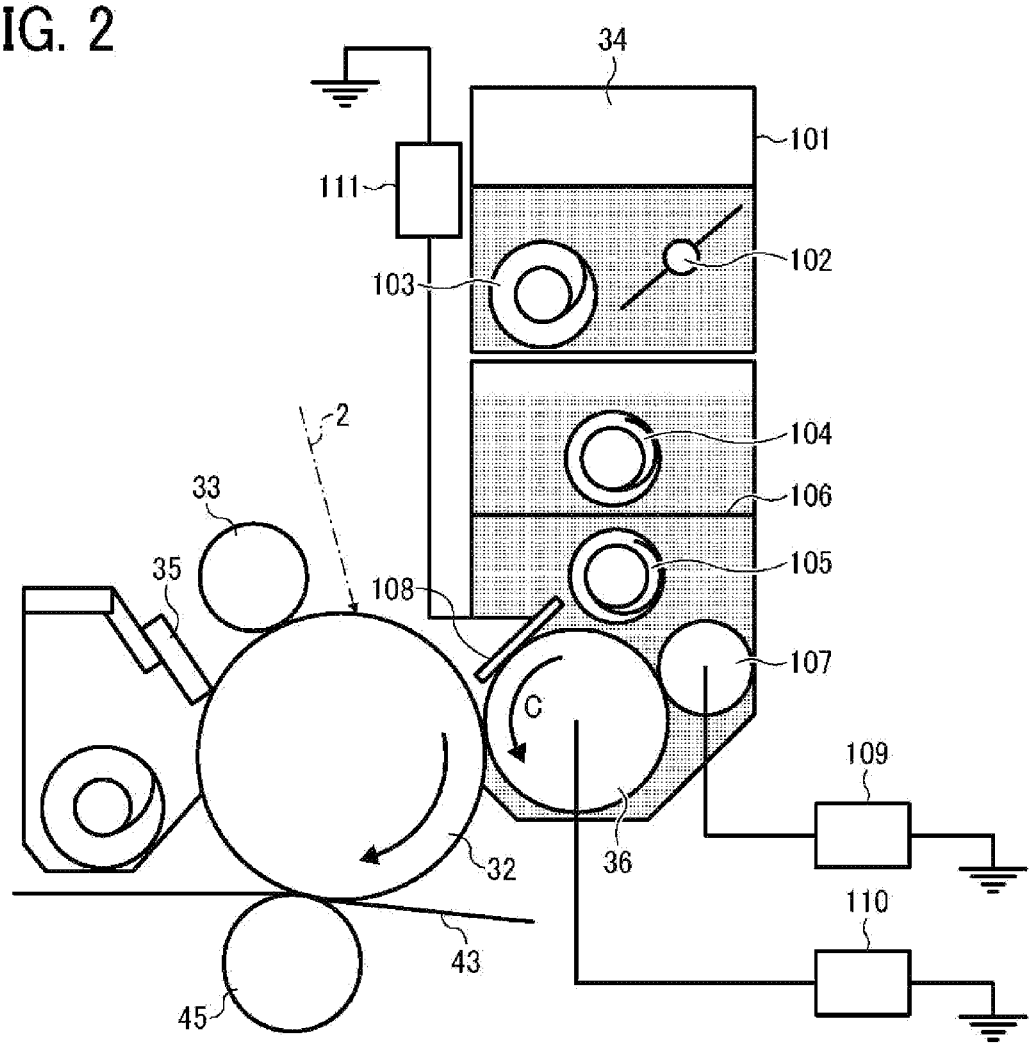
FIG. 2 is a schematic configuration diagram of a process unit according to an embodiment of the present disclosure.

As illustrated in FIG. 2, the developing device 34 includes a toner container 101 which contains a toner, a stirring paddle 102 which stirs the contained toner, first, second, and third transporters 103, 104, and 105 each of which is formed as a screw or a coil as a transporter, a partition plate 106 which defines the inside of the developing device 34, a supply roller 107 which serves as a supplier supplying a toner, the developing roller 36, and a regulation blade 108 which serves as a regulator regulating the thickness of the layer on the developing roller 36.

It is desirable to stir the toner inside the toner container 101 by the stirring paddle 102 at all times in order to keep the fluidity of the toner. Inside the toner container 101, the first transporter 103 is disposed at a toner supply port corresponding to a connection portion with respect to a toner supply passage of the image forming apparatus 1 or the developing device 34. The first transporter 103 transports the toner into the toner container 101.

The developing device 34 may be equipped with a remaining-amount detector which detects a toner remaining amount inside the developing device 34. Accordingly, it is possible to supply the toner from a supply port inside the toner container 101 when the toner remaining amount decreases, and hence to prevent the toner from being consumed up. Even in the toner container 101 which contains a small amount of a toner, it is possible to smoothly form an image by supplying a toner at each time, and hence to decrease the size of the developing device and the image forming apparatus.

The first transporter 103 is connected to a body driver by a clutch or the like, and is configured to freely supply the toner. The toner supply amount may be controlled by the drive time of the body driver. For example, the drive time may be changed in response to a change in the fluidity of the toner depending on the temperature and the humidity.

The partition plate 106 is disposed in the axial direction of the developing roller 36 and in a direction perpendicular to a sheet surface on which FIG. 2 is printed (hereinafter, simply referred to as a sheet surface direction), and includes an opening through which the toner is movable to the upper and lower chambers of the developing device 34 in the sheet surface direction.

The toner which is transported from the toner container 101 is transported in the sheet surface direction by the second transporter 104 disposed at the upper chamber, and the toner moves from the opening at the downstream side of the partition plate 106 in the transport direction to the lower chamber.

Then, the toner may be transported in a direction opposite to the second transporter 104 in the sheet surface direction by the third transporter 105 provided at the lower chamber. Further, another opening of the partition plate 106 is disposed at the downstream side of the third transporter 105 in the transport direction, and a part of the toner transported to the third transporter 105 is transported to the upper chamber again. In this way, the toner may circulate between the upper and lower chambers of the developing device 34 by the transporters and the opening of the partition plate 106.

When each transporter is formed as a screw, the transport speed for the toner increases in proportion to the screw pitch. This is because the toner amount transported per each revolution of the screw increases in response to the screw pitch. Thus, the same effect is obtained even when the screw diameter increases.

A driving force is transmitted from a driver provided in the apparatus body to the second transporter 104 and the third transporter 105 by a drive transmitter including a gear and a coupling.

The supply roller 107 is formed as a sponge, and contacts the developing roller 36. The supply roller 107 attracts thereon the toner circulating in the lower chamber of the developing device 34 and supplies the toner to the developing roller 36.

The regulation blade 108 contacts the developing roller 36. The developing roller 36 to which the toner is supplied from the supply roller 107 forms a toner layer on the surface thereof, and regulates the thickness of the toner layer at a predetermined value or less by the regulation blade 108 so as to obtain a uniform toner layer.

The developing roller 36 contacts the photoconductor drum 32, and supplies the toner to the photoconductor drum 32 by the amount in response to the surface potential of the photoconductor drum 32. Then, the photoconductor drum 32 to which the toner is supplied makes the electrostatic latent image formed on the surface thereof visible.

The toner image developed on the surface of the photoconductor drum 32 is transferred onto the intermediate transfer belt 43 by the primary transfer roller 45 contacting the photoconductor drum 32.

The toner which remains on the surface of the photoconductor drum 32 after the transfer operation is removed by the photoconductor cleaning blade 35 contacting the photoconductor drum 32, and is collected into the waste toner container 47.

The supply roller 107, the developing roller 36, and the regulation blade 108 are respectively provided with voltage applicators 109, 110, and 111, and the photoconductor drum 32 is provided with the charging roller 33. In a case where the developing operation is performed, a voltage is applied to these components, so that the toner moves by the potential difference generated between the supply roller 107 and the developing roller 36 and the potential difference generated between the developing roller 36 and the photoconductor drum 32.

The toner which is attached onto the surface of the supply roller 107 is supplied to the developing roller 36 due to the voltage difference generated between the supply roller 107 and the developing roller 36, and the developing roller 36 forms a toner layer on the surface thereof. The toner is scraped off from the developing roller 36 having the toner layer formed thereon by the regulation blade 108 contacting the developing roller, so that the thickness of the toner layer is uniformly regulated.

Figure 3:
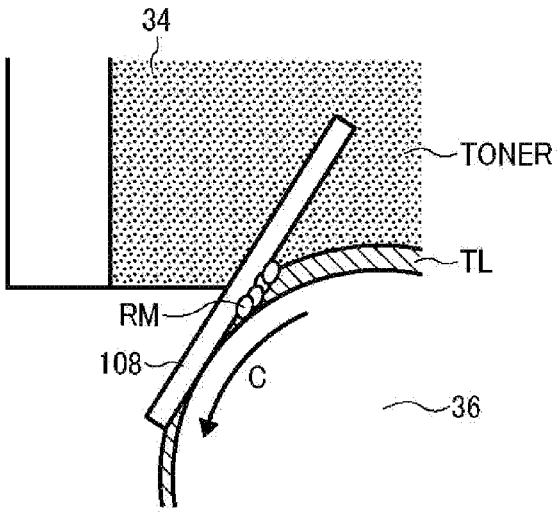
FIG. 3 is a diagram of a task according to an embodiment of the present disclosure.

As illustrated in FIG. 3, the toner which is scraped off by the regulation blade 108 is discharged into the developing device 34 so as to be circulated inside the developing device 34. However, a part of the toner or an externally added substance separated from the toner resides on the surface of the regulation blade 108 as a residual material (RM in FIG. 3).

Since the residual material RM is accumulated on the surface of the regulation blade 108 so that the mass increases in size, a toner layer TL may not be formed on the portion of the developing roller 36 and a streak-shaped faulty image may be formed.

(Method of Driving Process Unit)

Figure 4:
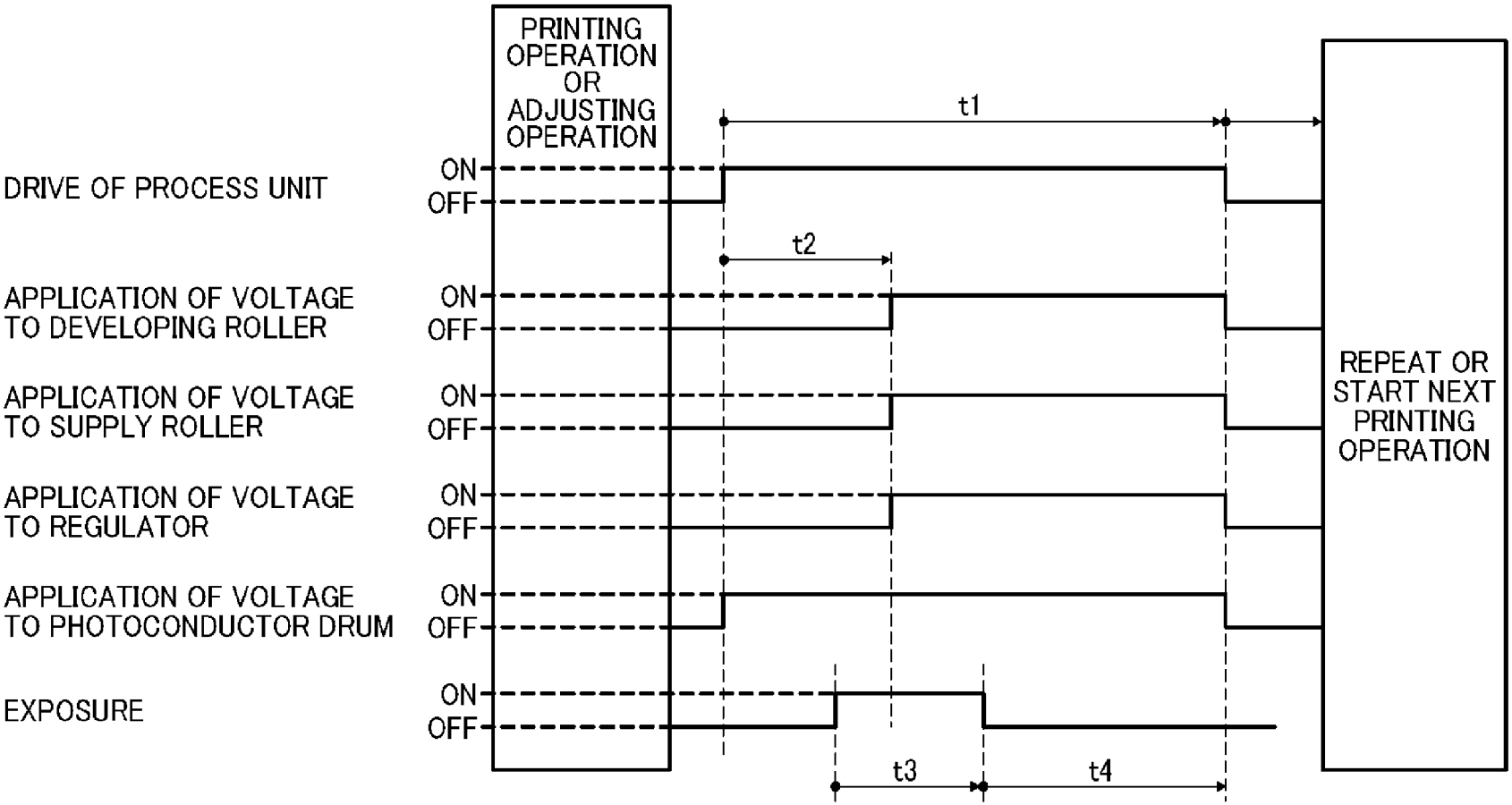
FIG. 4 is a diagram of a method of driving a process unit according to an embodiment of the present disclosure.

As a method of scraping off the residual material residing between the developing roller 36 and the regulation blade 108, a method of driving a process unit according to an embodiment of the present disclosure is illustrated in FIG. 4.

Figure 5:
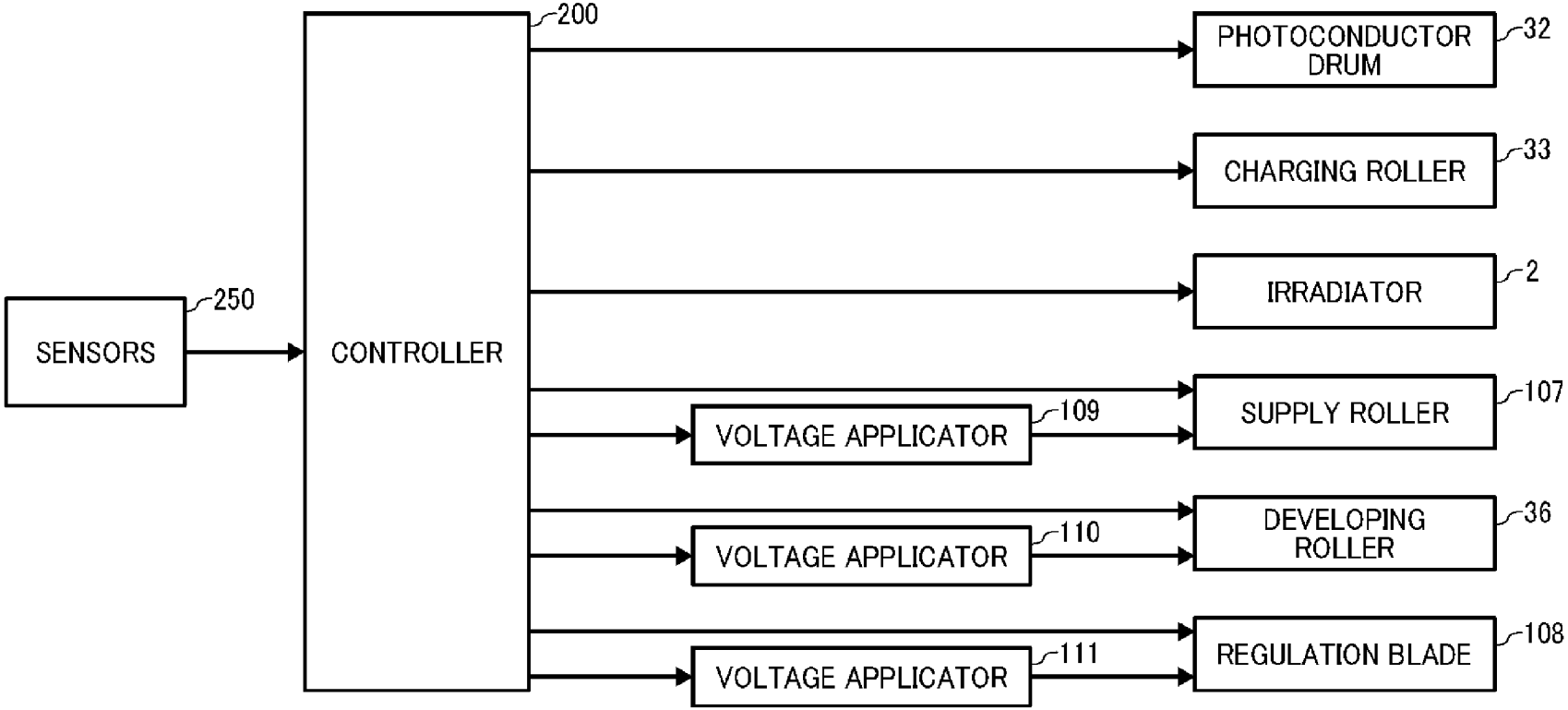
FIG. 5 is a block diagram of a controller according to an embodiment of the present disclosure.

A controller 200 of the image forming apparatus 1 includes, for example, a central processing unit (CPU) to control the entire image forming apparatus 1, a read only memory (ROM) to store fixed data, such as various programs, and a random access memory (RAM) to temporarily store data. As illustrated in FIG. 5, the controller 200 is connected to and drives the photoconductor drum 32, the charging roller 33, the irradiator 2, the supply roller 107, the developing roller 36, and the regulation blade 108. The controller 200 is also connected to the applicators 109, 110, and 111 to apply voltage to the supply roller 107, the developing roller 36, and the regulation blade 108, respectively. The controller 200 further includes, for example, an input-and-output (I/O) unit to receive data from various sensors 250 mounted to the image forming apparatus 1 and the process units 32. In accordance with data received from the sensors 250, the controller 200 controls driving of the photoconductor drum 32, the charging roller 33, the irradiator 2, the supply roller 107, the developing roller 36, and the regulation blade 108 and voltage application to the supply roller 107, the developing roller 36, and the regulation blade 108. The sensors 250 include, for example, sensors to monitor voltage of the applicators 109, 110, and 111 and the charging roller 33.

A series of operations (hereinafter, referred to as a driving operation of the present embodiment) for removing and collecting the residual material in the method of driving a process unit according to the present embodiment is performed during a non-image forming operation of the image forming apparatus 1.

As illustrated in FIG. 4, first, the controller 200 conducts a removal operation which drives the process unit 31 (an operation of driving each of the developing roller 36, the supply roller 107, and the photoconductor drum 32) only for the time t2 while applying a voltage only to the photoconductor drum 32 without applying a voltage to the developing roller 36, the regulation blade 108, and the supply roller 107. The time t2 is set to 0.15 seconds.

The residual material which resides on the surface of the regulation blade 108 includes an oppositely charged toner which is charged to a charge opposite to the toner. Such an oppositely charged toner adheres to the regulation blade 108 by the voltage applied to the regulation blade 108 during the image forming operation.

Since the developing roller 36 is driven to rotate in a direction indicated by arrow C (in FIGS. 2 and 3) while a voltage is not applied to the developing roller 36 and the regulation blade 108 during the removal operation of the present embodiment, a potential difference is not generated therebetween. Accordingly, it is possible to physically remove the toner adhering to the regulation blade 108 by the contact between the developing roller 36 and the regulation blade 108 and move the toner onto the surface of the developing roller 36 regardless of the influence of the potential difference. Accordingly, it is possible to remove even the toner adhering to the regulation blade 108 and electrically repelled during the image forming operation from the surface of the regulation blade 108.

Further, since a voltage is not applied to the supply roller 107 and a potential difference is not generated between the developing roller 36 and the supply roller 107 during the removal operation, the toner just physically adheres to the surface of the developing roller 36 while not being attracted from the supply roller 107 onto the surface of the developing roller 36 by an electric force. For this reason, the toner layer is not substantially formed on the surface of the developing roller 36.

Figure 6:
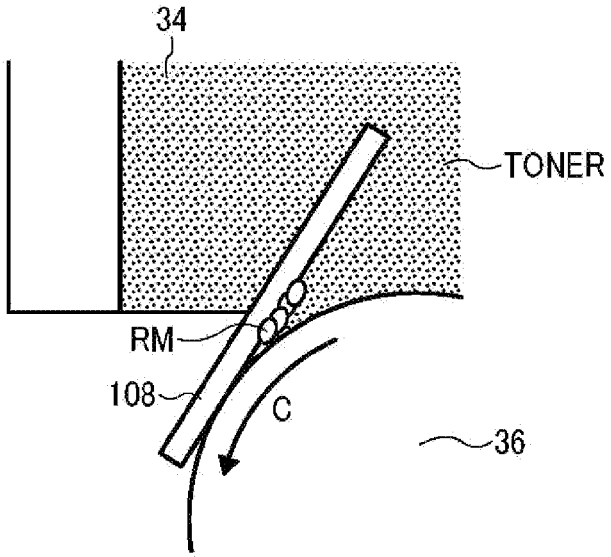
FIG. 6 is a diagram of the vicinity of a developing roller during a removal operation according to an embodiment of the present disclosure.

For this reason, as illustrated in FIG. 6, the surface of the developing roller 36 directly contacts the surface of the regulation blade 108, and hence the residual material RM accumulated on the surface of the regulation blade 108 directly contacts the developing roller 36. Alternatively, the residual material RM contacts the developing roller 36 via a toner layer thinner than the image forming operation. For this reason, an accumulated substance such as a toner on the surface of the regulation blade 108 more easily contacts the developing roller 36, and hence easily moves toward the developing roller 36.

In this way, the residual material RM on the regulation blade 108 moves toward the developing roller 36, and is carried on the surface thereof by the driving of the developing roller 36.

Further, since the supply roller 107 is driven without applying a voltage thereto, the developing roller 36 and the supply roller 107 are driven while the potential difference is not generated therebetween. Thus, the degraded toner having an opposite charge inside the developing device 34 and not attracted to the developing roller 36 due to the electric repelling state during the image forming operation physically adhere onto the surface of the developing roller 36, and hence the degraded toner may be removed from the developing device 34.

Figure 7:
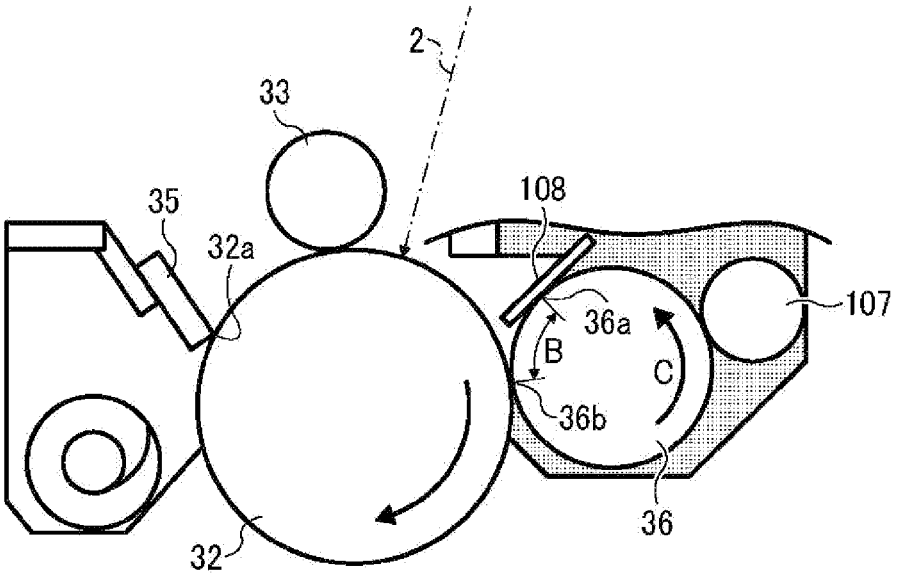
FIG. 7 is a diagram of a process unit according to an embodiment of the present disclosure.

As illustrated in FIG. 7, the time t2 is adjusted so that the surface movement distance of the developing roller 36 during the removal operation becomes equal to or shorter than a distance (a distance B of FIG. 7) from the contact position 36*a* between the developing roller 36 and the regulation blade 108 to the contact position 36*b* between the developing roller 36 and the photoconductor drum 32.

Accordingly, the residual material which is removed by the removal operation is not carried to the contact position 36*b* between the developing roller 36 and the photoconductor drum 32 during the removal operation, and the residual material does not adhere and reside again at the position while being sandwiched at the nip between the developing roller 36 and the photoconductor drum 32.

After the removal operation is performed for the time t2, a delivery operation is performed which drives the process unit 31 while a predetermined voltage is applied to each of the developing roller 36, the regulation blade 108, the supply roller 107, and the photoconductor drum 32.

Since a predetermined potential difference is generated between the developing roller 36 and the photoconductor drum 32 during the delivery operation, the toner may be delivered from the developing roller 36 to the photoconductor drum 32 by an electric force. Accordingly, the residual material which is removed from the regulation blade 108 by the removal operation and is moved to the developing roller 36 is further transported to the downstream side of the photoconductor drum 32.

In order to perform the delivery operation, it is desirable that the photoconductor drum 32 be charged and exposed to a predetermined potential until the residual material which is removed at the contact position 36*a* between the developing roller 36 and the regulation blade 108 by the removal operation is carried to the contact position 36*b* between the developing roller 36 and the photoconductor drum 32 and is carried to the photoconductor drum 32 by the potential difference at the contact position 36*b*.

For this reason, the controller 200 starts to expose the photoconductor drum 32 with the irradiator 2 before a voltage is applied to the developing roller 36, the regulation blade 108, and the supply roller 107 (a voltage is already applied during the removal operation). Accordingly, the timing in which the surface of the photoconductor drum 32 subjected to the application of the voltage and the exposure moves to the contact position 36*b* may match the timing in which the removed residual material is carried from the contact position 36*a* to the contact position 36*b*.

The photoconductor drum 32 is exposed for the time t3. The time t3 is set to 0.3 seconds. The residual material which is carried to the photoconductor drum 32 is carried to the contact position 32*a* between the photoconductor drum 32 and the photoconductor cleaning blade 35 by the rotation of the photoconductor drum 32. Then, the residual material is removed at the contact position 32*a* by the photoconductor cleaning blade 35 and is collected into the waste toner container 47 via a waste toner transport tube. Accordingly, it is possible to prevent a problem in which the residual material which is removed once flows on the surface of the photoconductor drum 32 or the developing roller 36 and resides at the contact position 36*a* between the developing roller 36 and the regulation blade 108 again.

In the above-described embodiment, the removed residual material is not carried to the contact position 36*b* between the developing roller 36 and the photoconductor drum 32 during the removal operation, but may pass through the contact position 36*b* during the removal operation. The time taken for one revolution of the developing roller 36 is about 0.3 seconds, and the developing roller 36 revolves once within the time t3 of the delivery operation. For this reason, even when the removed residual material passes through the contact position 36*b* between the developing roller 36 and the photoconductor drum 32 during the removal operation, the removed residual material passes through the contact position 36*b* again during the delivery operation and is moved to the photoconductor drum 32 at that time.

For this reason, a sequence has been described in which a voltage is applied to the photoconductor drum 32 before a voltage is applied to the developing roller 36, the regulation blade 108, and the supply roller 107, but both application operations may be started at the same time. Then, even the surface movement distance of the developing roller may be set to be equal to or longer than a distance (a distance B of FIG. 7) from the contact position 36*a* between the developing roller 36 and the regulation blade 108 to the contact position 36*b* between the developing roller 36 and the photoconductor drum 32 by the removal operation. However, the configuration of the present embodiment is more desirable.

In addition, the photoconductor cleaning blade 35 is formed as the collector. However, a configuration may be employed in which the residual material carried on the photoconductor drum 32 flows to the intermediate transfer belt 43 at a position where the photoconductor drum 32 faces the primary transfer roller 45, is carried on the intermediate transfer belt 43, and is collected by the cleaning blade 44 as the collector. In this way, the removed residual material is collected by the collector like the photoconductor cleaning blade 35 or the cleaning blade 44 disposed at the downstream side of the regulation blade 108 in the image formation step.

After the removal operation is performed for the time t3, the application of the voltage and the exposure for the photoconductor drum 32 is stopped, and the disposal operation is performed for the time t4.

In order to appropriately transport the residual material from the developing roller 36 to the photoconductor drum 32 in the removal operation, the surface of the photoconductor drum 32 becomes a state where an image may be formed on the entire surface of the photoconductor drum 32 in the width direction, that is, a state where a solid image may be formed thereon. For this reason, when the photoconductor drum 32 is stopped immediately after the delivery operation ends, a part of the solid image is formed on the recording sheet P at the next image forming operation. As a result, there is a possibility that a faulty image or a stain may be formed on the recording sheet P.

From the above-described reason, a disposal operation for returning the photoconductor drum 32 to a state where a desired image may be formed thereon is performed for the time t4, and the surface of the photoconductor drum 32 is returned to an original state. In the disposal operation, the photoconductor drum 32 is driven while the photoconductor drum 32 is not subjected to the application of the voltage and the exposure so that the toner remaining on the surface of the photoconductor drum 32 is removed and the surface of the photoconductor drum 32 is neutralized.

The reason why a voltage is applied to the supply roller 107 during the delivery operation and the disposal operation is because the toner needs to be attached to the surface of the supply roller 107 and the surface of the supply roller 107 needs to be protected. When the surface of the developing roller 36 and the surface of the exposed supply roller 107 contact each other in a rotation state, there is a concern that the surface of the exposed supply roller 107 may be worn out. Thus, the wear of the surface of the supply roller 107 is prevented in a manner such that a voltage is applied to the supply roller 107.

Further, it is desirable to perform the operations while a potential difference is not generated between the regulation blade 108 and the supply roller 107. This is because the adhering of the toner to the regulation blade 108 by the potential difference needs to be prevented even when the toner is carried from the supply roller 107 to the developing roller 36 by the potential difference.

In the delivery operation and the disposal operation, a voltage is applied to the components so that the potential of the supply roller 107 becomes the largest minus value as a relation of the supply roller 107>the regulation blade 108>the developing roller 36>the exposed photoconductor drum 32. The toner which is charged negatively by the potential of the developing roller 36 and the exposed photoconductor drum 32 is carried from the surface of the developing roller 36 to the photoconductor drum 32. However, embodiments of the present disclosure are not limited to the setting of the potential difference. In addition, the potential of the surface of the photoconductor drum 32 is adjusted in a manner such that a minus voltage is applied to the photoconductor drum 32 by the charging roller 33 and the minus potential thereof is decreased by the exposure of the irradiator 2 resulting in the potential difference.

In the driving operation of the present embodiment, an operation of performing the removal operation, the delivery operation, and the disposal operation in this order for the time t1 is set as a series of operations, and the series of operations is performed repeatedly N number of times. The time t1 is set to 2.0 seconds, and the number N of times is set to 3 times.

The driving operation of the present embodiment is performed during a non-image forming operation. In particular, the driving operation is performed before an image forming operation after a preliminary operation for the image forming operation or immediately after a series of image forming operations ends.

It is desirable that the driving operation of the present embodiment be performed every 10 to 250 recording sheets or 10 to 250 m of the surface movement distance of the photoconductor drum 32. When the driving operation of the present embodiment is not performed for a long period of time, a problem arises in that a faulty image is formed by the accumulation of the residual material.

In the toner which is used in the image forming apparatus of the present invention, the external additive added to the toner base of 100 parts by weight is 4.0 to 7.0 parts by weight, and the volume average particle diameter of the toner having the external additive added thereto is in the range of 5.5 to 6.7 μm.

Further, silica particles of which the accelerated aggregation degree is 55% or more and which are subjected to the surface treatment of silicone oil are added as external additive to the toner. Accordingly, it is possible to perform the image forming operation for a long period of time by suppressing the wear in the surface of the photoconductor drum 32 caused by the friction.

Further, in the description so far, the method of driving the process unit according to the present embodiment is divided into three operations of the removal operation, the delivery operation, and the disposal operation for convenience of the description. However, the residual material is removed only in the removal operation, and the removed residual material is transported only in the delivery operation. As described above, the timing for removing and transporting the residual material of the present embodiment is not completely divided by the separate operations. For example, even in the disposal operation after the time t3 elapses, there is a state where the surface of the photoconductor drum 32 exposed within the time t3 reaches the contact position 36*b* and the residual material is transported from the developing roller 36 to the photoconductor drum 32.

Further, in the removal operation, the process unit 31 is driven while a voltage is not applied to each of the developing roller 36, the regulation blade 108, and the supply roller 107. However, the same voltage may be applied to the developing roller 36 and the regulation blade 108, and the same voltage as the developing roller 36 may be applied to the supply roller 107.

(Test Result)

Next, FIG. 8 is a table of test results for the wear of the photoconductor drum or the image formation state in the image forming apparatus using the method of driving a process unit according to an embodiment of the present disclosure. Examples 1 to 4 illustrate the variations of various settings of the developing device according to an embodiment of the present disclosure, and Comparative Examples 1 to 4 illustrate comparison results with Examples.

Hereinafter, the setting values in Examples and Comparative Examples will be described.

Example 1

A predetermined print pattern having a coverage rate of 0.5% was copied by 10000 sheets as one job of three pages under the environment of 27° C. and 80% by the use of IPSiO SP C730 manufactured by Ricoh Company, Ltd. The clogging removal operation was performed every 100 sheets after the end of the print operation in the condition that the time t1 was set to 2.0 seconds, the time t2 was set to 0.15 seconds, the time t3 was set to 0.3 seconds, and the number N of times was set to 3 times in FIG. 4.

An additional refresh control was performed by developing the toner outside the developing device 34 so that the coverage rate became 2.0% every 300 sheets during the copying operation.

The weight of the external additive of the developer used was 5.5 parts by weight with respect to 100 parts by weight of the toner base, and the external additive containing at least one kind of the external additive subjected to a silicone treatment was used. Further, the volume average particle diameter of the toner having the external additive added thereto was 6.5 μm.

Example 2

Compared to the driving method of Example 1, a voltage was applied only to the supply roller 107 from the initial timing by using a single voltage output source or a delay circuit (the time t2 was set to 0 second).

Example 3

Compared to the driving method of Example 1, the driving method was performed every 25 sheets.

Example 4

Compared to the driving method of Example 1, a voltage was output from the start of the driving of the process unit 31 without the removal operation (the time t2 was set to 0 second).

Comparative Example 1

Compared to the driving method of Example 1, the driving method was performed every 500 sheets.

Comparative Example 2

Compared to the driving method of Example 1, the driving method was performed while the time t2 was set to 5 seconds.

Comparative Example 3

Compared to the driving method of Example 1, the driving method was performed without the disposal operation (the time t4 was set to 0 second).

Comparative Example 4

Compared to the driving method of Example 1, a developer only having silica not containing silicone oil added thereto was used. Further, the volume average particle diameter of the toner used was 7.5 μm.

(Evaluation Method)

Next, the evaluation method of each item will be described.

(Accelerated Aggregation Degree Measurement Method)

An accelerated aggregation degree measurement method is performed as below. As a measurement device, a Powder Tester manufactured by Hosokawa Micron Corporation is used, and accessories are set on a shaking table according to the following sequence. The accessories are fixed by (1) a vibro chute, (2) a packing, (3) a space ring, (4) a sieve (three kinds) of "upper>middle>lower", (5) a holding bar, and a knob nut, and the shaking table is operated. The measurement condition is set as below. Sieve openings are set so that the upper sieve opening is 75 μm, the middle sieve opening is 45 μm, and the low sieve opening is 20 μm. Then, an amplitude scale is set to 1 mm, a sampling amount is set to 2 g, and a shaking time is set to 10 seconds. After a measurement based on the above-described sequence, the accelerated aggregation degree is obtained by the following calculation.

(a) The weight percentage of the powder remaining at the upper sieve is multiplied by 1.0.

(b) The weight percentage of the powder remaining at the middle sieve is multiplied by 0.6.

(c) The weight percentage of the powder remaining at the lower sieve is multiplied by 0.2.

The accelerated aggregation degree [%] is set by the sum of the above-described three calculation values.

(Evaluation 1 for Longitudinal Streak)

A predetermined print pattern having a coverage rate of 0.5% was copied by 10000 sheets as one job of three pages under the environment of 27° C. and 80% by the use of IPSiO SP C730 manufactured by Ricoh Company, Ltd, and a refresh control was performed every 250 sheets during the copying operation so that the coverage rate became 2.0%. Then, a streak having an image density higher or lower than the periphery and generated in the recording sheet after the image forming operation was visually counted for determination. The determination standard is as below.

GOOD: Good (case where the number of the streaks is smaller than two)

POOR: Not actually usable (case where the number of the streaks is equal to or larger than two)

(Evaluation 2 for Wearing of Photoconductor)

Further, the durability of the photoconductor was evaluated based on the checking of the film thickness of the photoconductor. The thickness of the photoconductive layer was measured by using FISCHER SCOPE MMS (manufactured by Fischer Instruments K.K.) for measuring the film thickness before and after the running test of 10000 m, and the wear amount was set based on 5.0 μm or less. That is, a case where the wear amount was 5.0 μm or less was determined as "GOOD", and a case where the wear amount was 5.0 μm or more was determined as "POOR".

(Comparison of Results)

A satisfactory image formation result was obtained in Examples 1 to 3, and the number of image streaks of Evaluation 1 in Example 4 was larger than those of Examples 1 to 3. In Comparative Examples 1 to 4, any faulty was not found.

From the result of Example 2, any problem does not arise even when the supply roller 107 is driven while a voltage is applied thereto from the initial timing. The amount of the toner attached to the surface of the supply roller 107 increases, but a potential difference is not generated between the developing roller 36 and the regulation blade 108. Thus, it is found that the effect of removing the residual material residing therebetween is not largely influenced. Since a voltage is applied to the supply roller 107 from the initial timing, the wear of the surface of the supply roller 107 may be more reliably prevented.

From the result of Example 3, since the driving operation of the present invention is frequently performed, it is found that a faulty image formation may be more reliably prevented.

From the result of Example 4, a satisfactory result is obtained in Example 1 compared to Example 4. Since a potential difference is not generated between the developing roller 36 and the regulation blade 108 by the removal operation, it is found that the residual material may be efficiently removed.

From the result of Comparative Example 1, it is found that the frequency of performing the driving operation of the present invention whenever an image is formed on 500 recording sheets is not sufficient.

From the result of Comparative Example 2, there is a bad influence on the image forming operation when the time of the removal operation extends too much. That is, a voltage is not applied to the developing roller 36 and the photoconductor drum 32 during the removal operation, so that a potential difference is not generated therebetween. For this reason, the residual material removed from a gap between the developing roller 36 and the regulation blade 108 is not transported to the photoconductor drum 32. Then, the removed residual material continuously flows on the surface of the developing roller 36 so as to adhere to the regulation blade 108 again and to adhere to a seal portion provided at the entrance of the supply roller 107 as the position facing the developing roller 36. As a result, there is a bad influence on the image forming operation. Further, since the surface of the supply roller 107 is worn out due to the continuous operation while the surface of the supply roller 107 is exposed as described above, there is also a bad influence on the surface of the supply roller 107.

From the result of Comparative Example 3, since the disposal operation is not provided, it is found that there is a bad influence on the image forming operation. Here, the residual material between the developing roller 36 and the regulation blade 108 is removed. However, it is considered that a stain is generated in the image forming operation due to the influence of the solid image.

From the result of Comparative Example 4, since a developer only having silica not containing silicone oil added thereto is used, the friction between the developing roller 36 and the photoconductor drum 32 increases. Thus, it is considered that the surface of the photoconductor drum 32 is worn out.

While the embodiment of the present invention has been described, the present invention is not limited to the above-described embodiment, and various modifications may be made within the scope of the present invention. The image forming apparatus according to the present invention is not limited to the color image forming apparatus illustrated in FIG. 1, and may be a monochrome image forming apparatus, a copying machine, a printer, a facsimile, or a multifunction peripheral thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A process unit, comprising:

a latent image bearer to bear a latent image on a surface thereof;

a charger to charge the surface of the latent image bearer;

a developer bearer to supply a developer onto the latent image bearer to make the latent image a visible image;

a regulator to regulate a thickness of a layer of the developer on a surface of the developer bearer, the regulator makes contact with the developer bearer; and a supplier to supply the developer to the developer bearer;

wherein the developer bearer and the regulator are each to be applied a voltage that is controlled by a controller;

wherein the process unit is configured to perform a removal operation to remove a residual developer from the regulator to the developer bearer, and a delivery operation to deliver the residual developer from the developer bearer to the surface of the latent image bearer after the removal operation, in a non-image-formation period;

wherein, in the removal operation, the developer bearer rotates in a state that a potential difference between the regulator and the developer bearer is not generated; and wherein, in the delivery operation, the developer bearer rotates with the latent image bearer and delivers the residual developer to the surface of the latent image bearer by a potential difference generated between the developer bearer and the latent image bearer.

2. The process unit according to claim 1, further comprising a collector that makes contact with the surface of the latent image bearer;

wherein the process unit is configured to perform a disposal operation to collect the residual developer from the latent image bearer by the collector after the delivery operation.

3. The process unit according to claim 2, wherein a series of operations of the removal operation, the delivery operation, and the disposal operation is performed once or plural times every 10 to 250 recording media used for an image forming operation or every 10 to 250 m of a surface movement distance of the latent image bearer.

4. The process unit according to claim 2, wherein, in a series of operations of the removal operation, the delivery operation, and the disposal operation, the supplier is applied a voltage such that a potential difference between the regulator and the supplier is not generated.

5. The process unit according to claim 2, wherein, in the disposal operation, the developer bearer rotates in the same direction as supplying the developer onto the latent image bearer to make the latent image a visible image.

6. The process unit according to claim 2, wherein, in the disposal operation, the surface of the latent image bearer is neutralized.

7. The process unit according to claim 2, wherein, in a series of operations of the delivery operation and the disposal operation, the voltages applied to each of the supplier, the regulator, the developer bearer, and the latent image bearer satisfy a relationship about the potentials, the potential of the supplier is the largest minus value, and in this order, the supplier>the regulator>the developer bearer>the exposed latent image bearer.

8. The process unit according to claim 1, wherein the supplier is to be applied a voltage;

wherein, in the removal operation, the supplier is applied the voltage such that a potential difference between the developer bearer and the supplier is not generated.

9. The process unit according to claim 1, wherein a surface movement distance of the developer bearer in the removal operation is equal to or smaller than a distance from a contact position of the developer bearer with the regulator to a contact position of the developer bearer with the latent image bearer.

10. The process unit according to claim 1, wherein the developer contains a toner having an external additive added thereto, the external additive added to a toner base of 100 parts by weight is 4.0 to 7.0 parts by weight, and a volume average particle diameter of the toner having the external additive added thereto is 5.5 to 6.7 μm.

11. The process unit according to claim 1, wherein the developer contains a toner having an accelerated aggregation degree of 55% or more and includes, as an external additive, silica particles subjected to a surface treatment of silicone oil.

12. An image forming apparatus, comprising:

a latent image bearer to bear a latent image on a surface thereof;

a charger to charge the surface of the latent image bearer;

a developer bearer to supply a developer onto the latent image bearer to make the latent image a visible image;

a regulator to regulate a thickness of a layer of the developer on a surface of the developer bearer, the regulator makes contact with the developer bearer;

a supplier to supply the developer to the developer bearer;

a plurality of voltage applicators to apply respective voltages to the supplier, the developer bearer, and the regulator; and a controller configured to control a voltage application of the voltage applicators, and to control driving of the latent image bearer, the charger, the developer bearer, and the supplier;

wherein, in a non-image-formation period, the controller is configured to perform a removal operation to remove a residual developer from the regulator to the developer bearer, and to perform a delivery operation to deliver the residual developer from the developer bearer to the surface of the latent image after the removal operation;

wherein, in the removal operation, the developer bearer rotates in a state that a potential difference between the regulator and the developer bearer is not generated; and wherein, in the delivery operation, the developer bearer rotates with the latent image bearer and delivers the residual developer to the surface of the latent image bearer by a potential difference generated between the developer bearer and the latent image bearer.

13. The image forming apparatus according to claim 12, further comprising an irradiator to expose the latent image bearer;

wherein, in the delivery operation, the irradiator exposes the surface of the latent image bearer.

14. The image forming apparatus according to claim 12, further comprising a collector that makes contact with the surface of the latent image bearer;

wherein the controller is configured to perform a disposal operation to collect the residual developer from the latent image bearer by the collector after the delivery operation.

15. The image forming apparatus according to claim 14, wherein, in the disposal operation, the developer bearer rotates in the same direction as supplying the developer onto the latent image bearer to make the latent image a visible image.

16. The image forming apparatus according to claim 14, wherein, in a series of operations of the removal operation, the delivery operation, and the disposal operation, the controller controls the voltage applicators such that a potential difference between the regulator and the supplier is not generated.

17. The image forming apparatus according to claim 14, further comprising an irradiator to expose the latent image bearer;

wherein, in the disposal operation, the irradiator does not expose the surface of the latent image bearer.

18. The image forming apparatus according to claim 12, wherein, in the removal operation, the controller controls the voltage applicators such that a potential difference between the developer bearer and the supplier is not generated.

19. The image forming apparatus according to claim 12, wherein a surface movement distance of the developer bearer in the removal operation is not greater than a distance from a contact position of the developer bearer with the regulator to a contact position of the developer bearer with the latent image bearer.

* * * * *